United States Patent [19]

Glenn

[11] Patent Number: 5,031,554

[45] Date of Patent: Jul. 16, 1991

[54] METHOD OF FORMING A CONVOLUTED NARROW FABRIC ON A SEWING MACHINE

[75] Inventor: Douglas J. Glenn, Wallburg, N.C.

[73] Assignee: Sewing Center Supply Co., Inc., Portland, Oreg.

[21] Appl. No.: 489,878

[22] Filed: Mar. 6, 1990

Related U.S. Application Data

[62] Division of Ser. No. 343,842, Apr. 26, 1989, abandoned.

[51] Int. Cl.[5] ..... D05C 7/08

[52] U.S. Cl. ..... 112/266.1; 112/25; 112/132; 112/144; 112/414; 112/427

[58] Field of Search ..... 112/303

[56] References Cited

U.S. PATENT DOCUMENTS 2,183,828 12/1939 Trubitz ..... 112/414 X
2,699,742 1/1955 Smith .
3,369,303 2/1968 Henry ..... 223/28 X
4,067,278 1/1978 Davis .
4,583,472 4/1986 Johnson ..... 112/132

FOREIGN PATENT DOCUMENTS 2174112 10/1986 United Kingdom ..... 112/412

*Primary Examiner*—Andrew M. Falik
*Attorney, Agent, or Firm*—Marger, Johnson, McCollum & Stolowitz, Inc.

[57] ABSTRACT

A method for the production of decorative fabrics having flat narrow fabrics stitchingly secured in a longitudinally compressed convoluted condition to a substrate or devoid of a substrate. The narrow fabrics are such as lace, ribbon, braid or tape. The narrow fabric is guided into the path of a conventional reciprocating sewing needle whereby the needle on each downward stroke strikes the narrow fabric and advances it in a compressed convoluted condition toward the needle plate whereupon the fabric is attached in its compressed convoluted condition.

4 Claims, 3 Drawing Sheets

METHOD OF FORMING A CONVOLUTED NARROW FABRIC ON A SEWING MACHINE

This application is a division of application Ser. No. 343,842, filed Apr. 26, 1989.

U.S. Pat. Nos. 4,640,208 and 4,640,209, (the disclosures thereof which are incorporated herein by reference) describe apparatus and process for making fabrics formed from effect yarns wherein the effect yarns are in a longitudinally compressed bulked condition imparting an expanded cross-sectional width to the effect yarn. The fabrics may be formed by the process of securing the effect yarns by stitching to a substrate or in overlapping relation to the yarns themselves. The result of this process is the enhancement of fabrics comprising an appearance of effect yarn much larger than that actually present on the fabric.

It is an object of this invention to provide a wide variety of different types of decorative fabrics utilizing narrow fabrics, such as lace, ribbon, braid or tape stitchingly secured in longitudinally compressed and convoluted condition to a substrate, or if desired, in longitudinally compressed and convoluted condition devoid of a substrate.

It is a further object of this invention to provide apparatus in association with a sewing machine, for enabling the guiding of a narrow fabric into the path of a sewing needle in juxtaposition to the needle plate of the sewing machine so as to stitchingly secure the narrow fabric into a longitudinally compressed convoluted condition.

The preferred mode for forming fabrics of this invention is through the use of a sewing machine provided with a reciprocating sewing needle but without the conventional presser foot and feed dog so that the fabrics formed by use of the apparatus may be guided in any direction transversely of the needle.

DETAILED DESCRIPTION

The Product

The textile fabric of the present invention displays a variety of effects and patterns which may be varied by the selection of a narrow fabric such as lace, ribbon, braid or tape. It should be noted that other effects and patterns may be achieved which are within the scope of the invention but are not illustrated.

Figure 1:
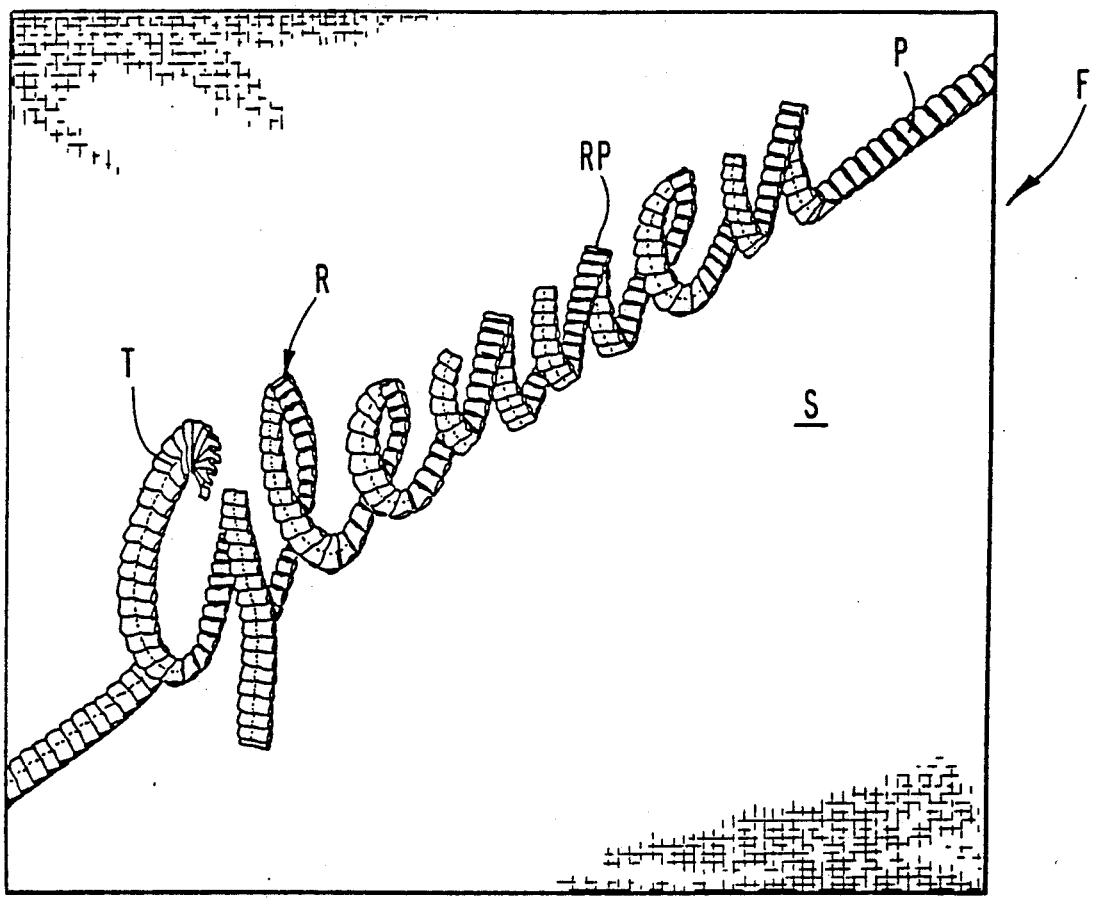
FIG. 1 is a view of the face surface of decoratively enhanced textile fabric illustrating one embodiment of the fabric of this invention.

Referring to FIG. 1, there is shown the face surface of a decoratively enhanced textile fabric F serving as a substrate S, and narrow fabric R arranged on said substrate in a predetermined manner. The narrow fabric R is in the form of a longitudinally compressed and convoluted flat fabric, which may be, for example, lace, ribbon, braid or tape. In the form shown in FIG. 1 the narrow fabric R consists of regular pleats P and reverse pleats RP which are stitchingly secured to the substrate S by a sewing thread T. It is noted that the thread I is clearly visible only in portions of the narrow fabric serving as reverse pleats RP, due to the nature of the decorative style accompanying the product of this invention, however in all cases the thread T securely affixes each convolution of narrow fabric to the substrate S.

Figure 2:
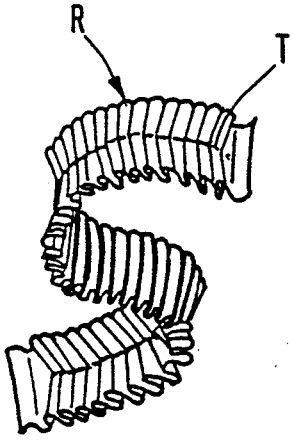
FIG. 2 is a schematic perspective view of a decoratively enhanced textile fabric illustrating another embodiment of the fabric of this invention.
Figure 3:
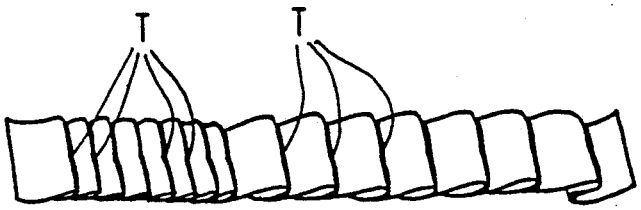
FIG. 3 is a schematic view of a decoratively enhanced textile fabric showing a manner of achieving varied decorative effects in accordance with the process and apparatus of this invention.

Referring to FIG. 2, there is shown another decoratively enhanced textile fabric of this invention in which successive portions of narrow fabric R are stitchingly secured by the thread T to other portions of the narrow fabric in overlapping relation and in a longitudinally compressed convoluted condition. This decorative fabric may be utilized in conventional ways of decorating garments and other fabrics well understood by fashion designers and garment manufacturers. This product may be modified as shown in FIG. 3 by varying the length of narrow fabric between adjacent stitches of thread T within the range of from about 1.5 to 8 times the linear distance between adjacent points at which adjacent stitches extend through the narrow fabric, with about 4 to 5 times being the preferred ratio.

Figure 4:
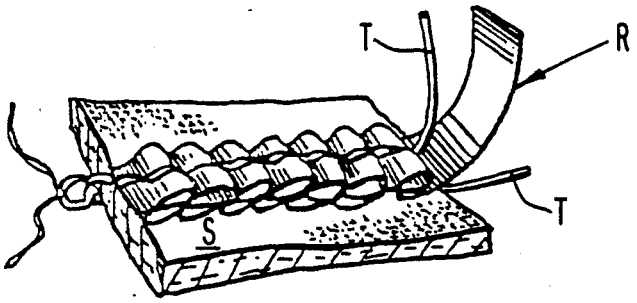
FIG. 4 is a perspective view in detail, showing how the narrow fabric is stitched onto a substrate in a decoratively enhanced manner.

In FIG. 4 there is shown the stitching detail of a fabric in accordance with the invention, wherein a flat narrow fabric R has been longitudinally compressed and convoluted and stitched in that form by stitching threads T (shown as a lock-stitch) to a substrate S.

Figure 5:
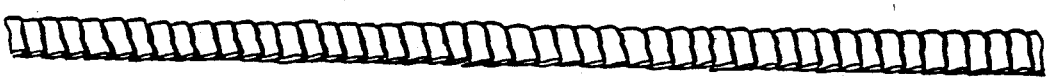
FIG. 5 is a view of the face surface of a permanently pleated fabric having regular pleats illustrating another embodiment of the fabric of this invention.
Figure 6:
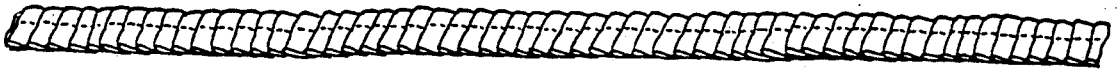
FIG. 6 is a view of the face surface of a permanently pleated fabric having reverse pleats illustrating another embodiment of the fabric of this invention.

FIG. 5 illustrates the face surface effect of regular pleated fabric formed in accordance with this invention, while FIG. 6 illustrates the appearance of a reverse pleated fabric so formed.

Figure 7:
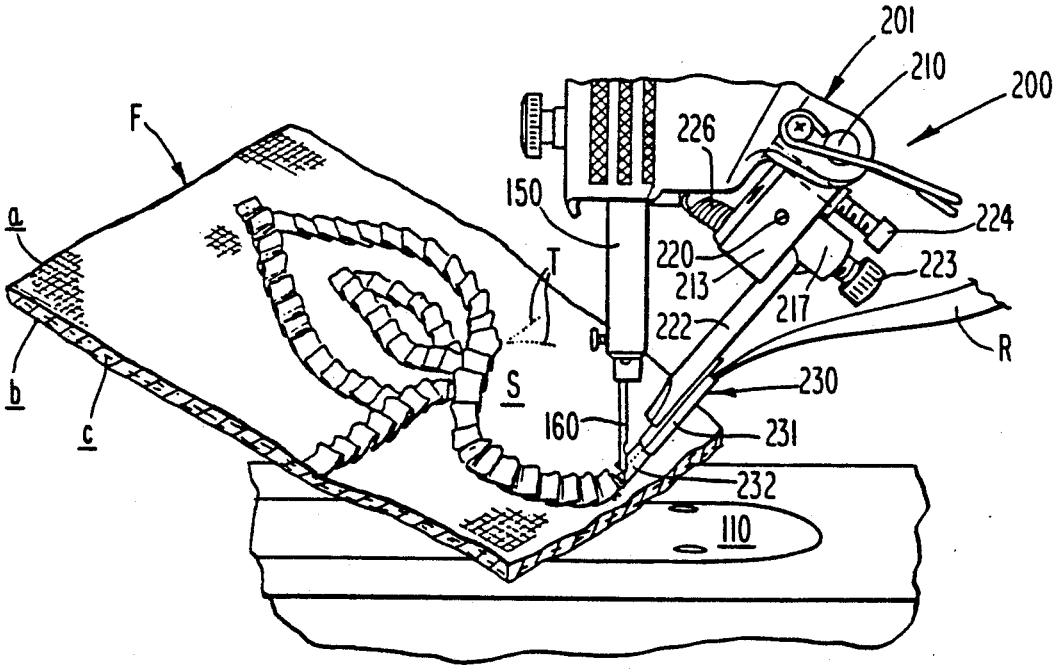
FIG. 7 is an enlarged perspective view of the sewing apparatus of this invention incorporating the textile guide of this invention during the process of forming a decoratively enhanced textile fabric of this invention.

In FIG. 7 the narrow fabric R is stitched to a quilted fabric F serving as the substrate S. The quilted fabric is composed of layers a, b of fabric with an intervening layer c of a suitable filling material sandwiched therebetween, and lines of stitching thread T are used to secure layers a, b, c together as quilting in the pattern formed by the narrow fabric R. Plain quilting may as well be further quilted in the decorative manner of this invention.

The Apparatus

Referring to FIG. 7, the narrow fabric R is shown being stitched to the fabric F by the guide apparatus broadly designated at 200, in cooperation with the needle plate 110, a sewing needle 160, and a vertically reciprocatable needle bar 150. This apparatus is adapted to be operated by a conventional sewing machine (portions not shown) which may be a standard sewing machine, a quilting machine, or any industrial version thereof.

The guide apparatus 200 serves to guide the narrow fabric R toward the point of needle 160 for stitching the fabric R to the substrate S. To this end, the guide apparatus 200 comprises a mounting bracket generally indicated at 201, a shaft 210 journaled within bracket 201, and a block 213 suitably secured on shaft 210. Block 213 is suitably bored so as to receive and hold the cylindrical guide apparatus mounting rod 217. A set screw 220 serves to secure the mounting rod 217 to the block 213. Mounting rod 217 is bored perpendicularly so as to receive the stem portion 222 of a feed folder 230. Stem portion 222 is adjustably secured within mounting rod 217 by means of set screw 223. In order to adjustably limit the extent of inward movement of the feed folder 230 toward the needle 160, an adjustable abutment or set screw with locknut 224 is provided which is threaded through a section of block 213 and is adapted to be engaged as a limit stop by bracket 201. The feed folder 230 is urged or biased toward the innermost position by a suitable biasing or spring means 226. It is thus apparent that the spring means 226 normally urges the block 213 toward the needle bar 150.

Figure 8:
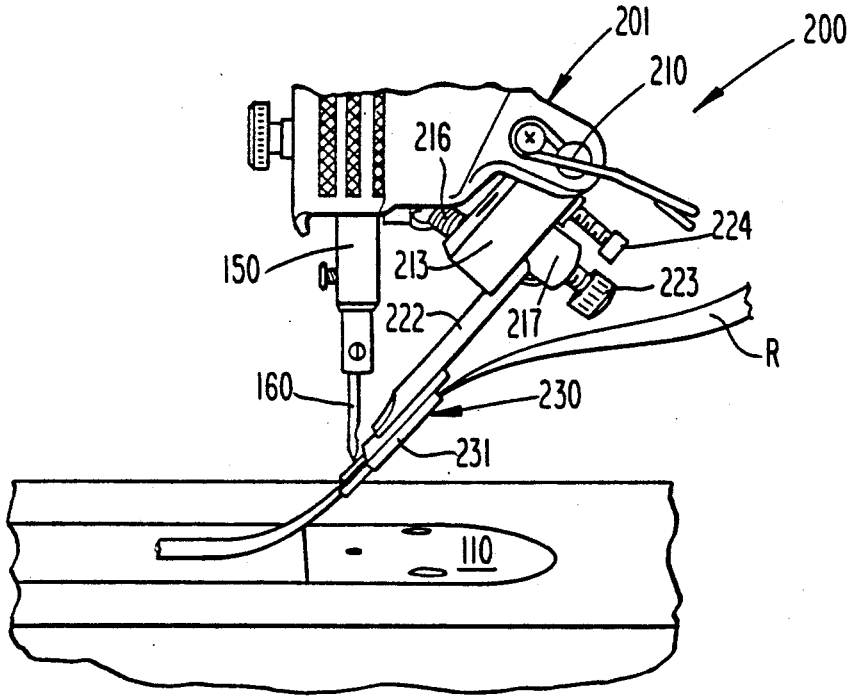
FIG. 8 is a view similar to FIG. 7 illustrating the condition of narrow fabric prior to the operation of the process and apparatus of this invention.

Feed folder 230 in the illustrated embodiment of FIG. 7 extends generally downwardly and inwardly at an angle so that the free (distal) end thereof may underlie the path of the sewing needle 160 when the needle occupies its raised position (see FIG. 8). Referring to FIGS. 7,8 the feed folder 230 is shown consisting of a body portion 231, which is a hollow parallelopiped means formed with a narrow passage therethrough to receive and guide a narrow fabric R (see FIG. 8); a terminal channel-shaped tip portion 232 opening upwardly and capable of supporting a narrow fabric for contact by the needle 160; and a stem portion 222. The feed folder 230 thus guides the narrow fabric R under the path of the sewing needle 160 and during the stitching process functions in combination with other elements of the apparatus to properly fold the narrow fabric R in a decorative manner.

Figure 10:
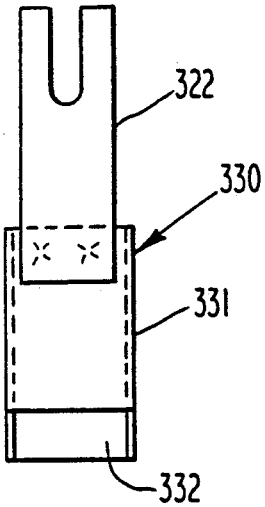
FIG. 10 is a top view of a guide apparatus in accordance with one embodiment of this invention.
Figure 9:
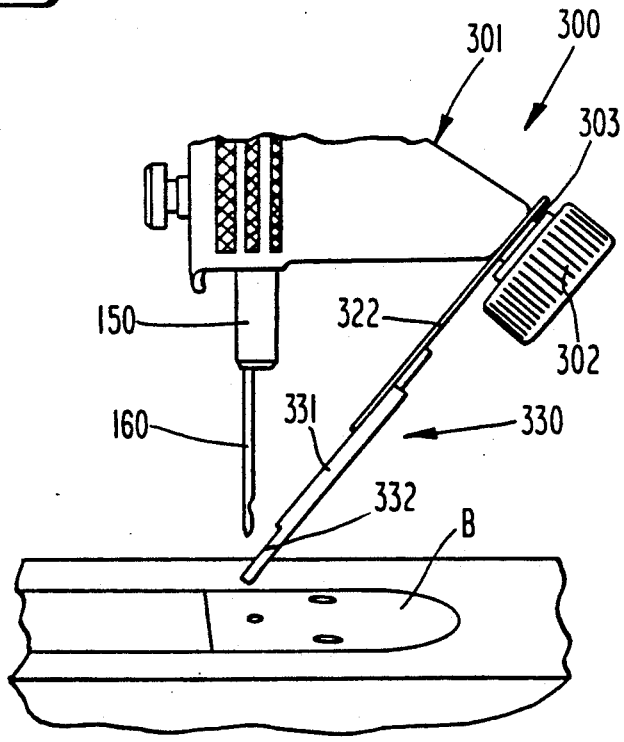
FIG. 9 is a side view of a portion of a conventional sewing machine modified to illustrate another embodiment of the apparatus of this invention.

In FIG. 9, illustrating another embodiment of the apparatus of this invention, the guide apparatus broadly designated at 300, comprises a bracket 301, a thumb screw 302, a washer 303, and a feed folder 330. Referring also to FIG. 10, the feed folder 330 consists of a body portion 331, which is a hollow parallelopiped means formed with a narrow passage therethrough; a terminal channel-shaped tip portion 332 opening upwardly and capable of supporting a narrow fabric for contact by the needle 160; and a stem portion 322. Stem portion 322 is a flat spring which is affixed at one end to the body portion 331 by spot welding or other method, and which is slotted at its other end so as to be receivable by the thumb screw 302, and adjustably securred to bracket 301.

The Method

According to the method of this invention, a decorative textile fabric F is formed from a substrate S and a decorative narrow fabric R. Accordingly it can be appreciated that the feed folders 230, 330 serve to guide the narrow fabric R in a predetermined path of travel as best illustrated in FIGS. 7,8 to a position underlying the vertically reciprocating needle 160 and overlying the substrate S. Thus, as the needle 160 moves downwardly with each vertical reciprocation thereof, it engages and penetrates a portion of the narrow fabric R and draws more narrow fabric from the body portions 231,331 of the feed folders 230,330. This action causes the narrow fabric R to begin a folding movement which compresses the narrow fabric longitudinally. As the needle 160 continues to reciprocate, each portion of the narrow fabric which is penetrated by needle 160 is stitched to the substrate by the stitching thread T carried by the needle 160 at locations on the fabric F determined by the movement of the fabric F under the needle 160. The ability to move a fabric in any direction while permanently applying an overlaying decorative fabric thereto is unexpected. This may be accomplished by the action of a conventional bobbin and shuttle hook (not shown) and forming the stitching as shown in FIG. 4 as a lock stitch. In known manner, the stitching may be created in other forms such as chain stitching. From the foregoing description, it can be appreciated that, during the course of each downward stroke of the needle 160 and the stitching thread T carried thereby, the needle 160 engages the narrow fabric R at a position some distance above the substrate S before the needle reaches such substrate, thus advancing a substantial length of the narrow fabric R before the corresponding stitch is formed by the needle as it penetrates and is removed from respectively the narrow fabric R and the substrate S. It has been determined that an effective length of the narrow fabric R between adjacent stitches of stitch thread T is within the range of from about 1.5 to 8 times the linear distance between adjacent stitches. It will be apparent from FIG. 3 that the variation of this effective length will produce varying decorative effects. The determining factor of the length of fabric R advanced between each stitch is the vertical distance between the substrate S and the point at which the needle 160 strikes the fabric R in the downward movement of the needle 160.

It has also been unexpectedly observed during the formation of decoratively enhanced fabric according to this invention, that without the aid of either a conventional presser foot or feed dog, narrow fabric may be fed from a supply reel without tension by virtue of the combination of forces created by the interaction of the needle, feed folder, narrow fabric and needle plate B.

In accordance with the method of this invention, other decorative effects may be created with narrow fabric materials by varying the point at which the needle engages the fabric in a transverse direction. The apparatus of this invention as described is obviously constructed so as to permit adjustment of the feed folding means so as to permit such variations of the method. Likewise, in addition to varying the distance from the substrate at which the reciprocating needle engages the fabric, variations of stitch length and feed tension on the fabric will cause further variations in decorative effects that may be achieved.

Having thus described my invention, I claim:

1. A method of forming a decorative textile fabric from a narrow fabric which comprises guiding a continuous length of narrow fabric in a predetermined path of travel to a position adjacent a vertically reciprocating needle of a sewing machine while said fabric is supported upon a solid surface which is resiliently biased into the path of the vertically reciprocating needle, causing the vertically reciprocating needle to strike said narrow fabric upon said solid surface, thereby advancing said narrow fabric in its path of travel so as to form repetitive convolutions transversely of the narrow fabric which are then permanently stitched with thread into a compressed longitudinal condition by the continued action of the vertically reciprocating needle.

2. The method of claim 1, wherein the decorative textile fabric is simultaneously applied to a substrate by said thread.

3. The method of claim 2, wherein the substrate is a quilting material which is quilted by the application of the decorative textile fabric thereto.

4. The method of claim 2, wherein the substrate is moved manually so as to form a desired pattern upon the substrate.

* * * * *